US006474100B1

(12) United States Patent
Smith et al.

(10) Patent No.: US 6,474,100 B1
(45) Date of Patent: Nov. 5, 2002

(54) EVACUATED SORBENT ASSEMBLY AND COOLING DEVICE

(75) Inventors: Douglas Smith, Albuquerque, NM (US); Kevin Roderick, Albuquerque, NM (US); Lyra Fiset, Albuquerque, NM (US); Robert Braun, Albuquerque, NM (US)

(73) Assignee: Thermal Products Development Inc., Glendale, CA (US)

( * ) Notice: Subject to any disclaimer, the term of this patent is extended or adjusted under 35 U.S.C. 154(b) by 0 days.

(21) Appl. No.: 09/844,295

(22) Filed: Apr. 25, 2001

(51) Int. Cl.[7] ..... F25B 17/08; F25B 15/00

(52) U.S. Cl. ..... 62/480; 62/60; 62/101; 62/457.3

(58) Field of Search ..... 62/480, 371, 60, 62/457.3, 457.9, 530, 293, 238.3, 294, 101

(56) References Cited

U.S. PATENT DOCUMENTS

| | | | | |
|---|---|---|---|---|
| 4,532,778 A | * | 8/1985 | Clark et al. | 62/238.3 X |
| 4,736,599 A | * | 4/1988 | Siegel | 62/294 |
| 5,048,301 A | * | 9/1991 | Sabin et al. | 62/101 |
| 5,079,932 A | * | 1/1992 | Siegel | 62/293 |
| 5,197,302 A | * | 3/1993 | Sabin et al. | 62/101 X |
| 5,692,381 A | * | 12/1997 | Garrett | 62/60 |

FOREIGN PATENT DOCUMENTS

WO WO-00/50823 A1 * 8/2000

* cited by examiner

*Primary Examiner*—Chen-Wen Jiang
(74) *Attorney, Agent, or Firm*—Gordon & Rees, LLP; Marc E. Hankin

(57) ABSTRACT

An evacuated sorbent driven cooling device which may be added to a beverage or food container and which may also be affixed to, or integrated within, a panel of a beverage container.

64 Claims, 7 Drawing Sheets

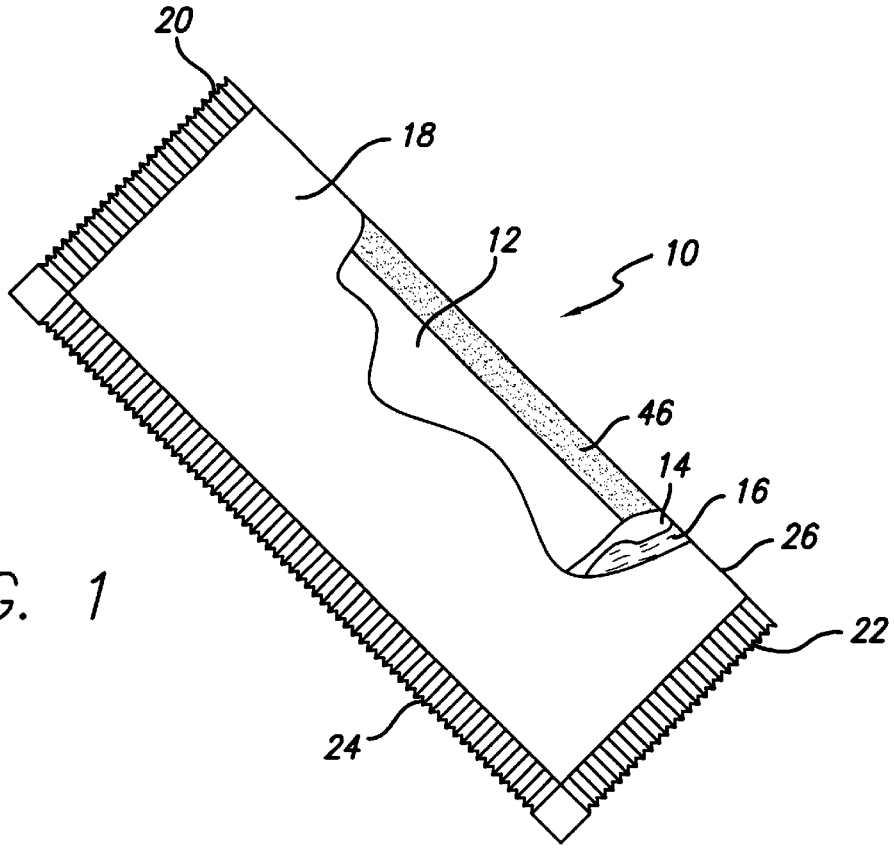
FIG. 1
FIG. 3
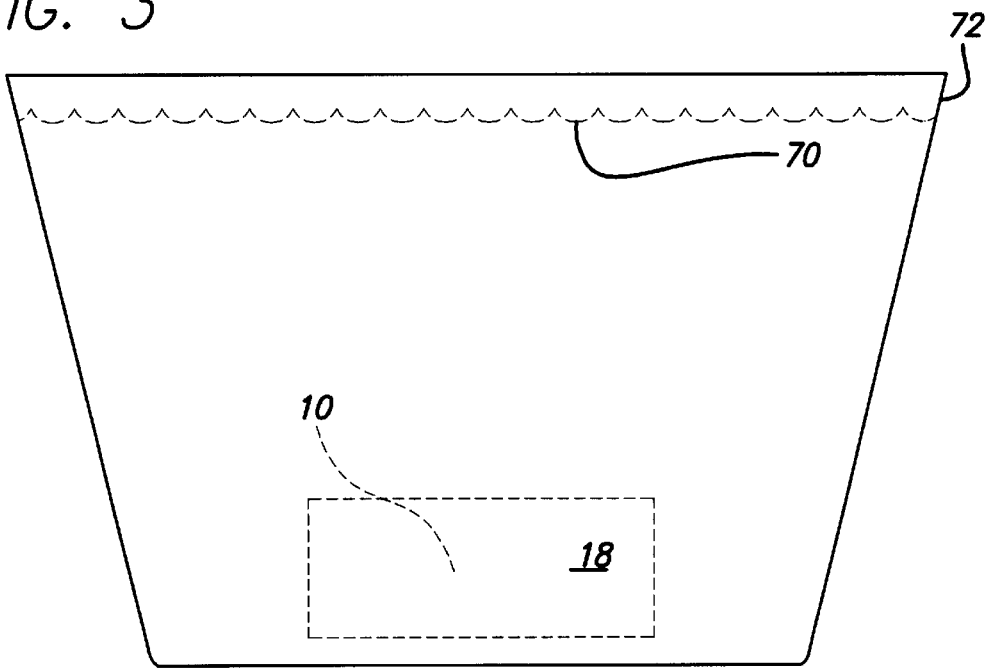

14
16
120
64
100
95
94
50
28
46
52
56
92
90
80
82
83
84
85
103
104
102
116
114
110
73
71
72
112

EVACUATED SORBENT ASSEMBLY AND COOLING DEVICE

BACKGROUND OF THE INVENTION

1. Field of the Invention

The present invention relates to the mechanical arts. In particular, the present invention relates to a sorbent assembly for use with sorbent-driven cooling devices.

2. Discussion of the Related Art

There have been many attempts to manufacture an inexpensive, lightweight, compact cooling device that employs an adsorbent to adsorb a liquid refrigerant such as water. In such a cooling device, there are typically two chambers, one housing the adsorbent and the other housing the liquid refrigerant, in thermal contact with the medium to be cooled. To achieve an effective cooling action, both the adsorbent chamber and the liquid refrigerant chamber must be evacuated. The adsorbent chamber, in particular, must have a substantial vacuum condition (evacuated to less than $8\times10^{-4}$ mm Hg). When communication is opened between the two chambers, some of the liquid refrigerant is caused to vaporize and flow into the adsorbent chamber, where the vapor is adsorbed by the adsorbent. The latent heat of vaporization causes heat to be removed from the media adjacent the liquid. The adsorption of the vapor causes additional liquid to be vaporized, thus further continuing the cooling process.

One particular application for which adsorbent-driven cooling devices have been considered is for the rapid chilling of a beverage. One such device is described in U.S. Pat. No. 4,928,495. This patent describes a self-contained cooling device in which a cooling effect is produced by causing a liquid refrigerant to evaporate in a chamber within a beverage container and in the process absorb heat from its surroundings. The resulting refrigerant vapor is then adsorbed by an adsorbent housed in a chamber located outside of the beverage container. While this device may act to cool a beverage placed within the container, the difficulties and costs associated with manufacturing a beverage container with an external adsorbent chamber are a significant impediment to mass production of such containers. In addition, with this arrangement, the path in which the vaporized liquid must travel before it is adsorbed by the adsorbent is long, which prevents the cooling device, from adequately cooling the beverage within a commercially acceptable amount of time.

Another beverage cooling device is described in U.S. Pat. No. 6,151,911. This patent describes a mechanism for cooling a contained beverage by use of an absorption or adsorption substrate in thermal contact with a phase change medium. It is a drawback of this cooling device in that it requires a cylindrical chamber with a lengthy vapor pathway to avoid liquid contact from the phase change medium with the adsorption or adsorption substrate.

Accordingly, it should be recognized that there remains a need for an adsorbent assembly and cooling device that is easy and inexpensive to manufacture, is compact and lightweight, and has a short vapor path while providing effective cooling characteristics. The present invention satisfies these and other needs.

SUMMARY OF THE INVENTION

The invention resides in an evacuated sorbent assembly and cooling device that provide advantages over known adsorbent-driven cooling devices in that the invention is easy and inexpensive to manufacture. Also, the invention is compact and lightweight, and has a short vapor path. Additionally, the invention provides effective cooling characteristics.

The present invention is embodied in an evacuated sorbent assembly for coupling to a liquid refrigerant reservoir and a cooling device comprised of at least one sorbent section, at least one liquid passageway section, and an actuator. The sorbent section contains a sorbent for a liquid refrigerant. The liquid passageway section is adjacent the sorbent section and defines a liquid passageway through a portion of the evacuated sorbent assembly or cooling device to the sorbent section. The liquid passageway contains wicking material of an amount sufficient to prevent the liquid refrigerant from contacting the sorbent. The actuator controls liquid communication between the liquid passageway section and the liquid refrigerant reservoir. In another embodiment, the evacuated sorbent assembly includes a vapor-permeable membrane that separates adjacent sorbent and liquid passageway sections whether or not the liquid passageway section contains wicking material.

Embodiments of the cooling device additionally include a liquid refrigerant reservoir, adjacent the liquid passageway section, and a casing that surrounds the sorbent section, the liquid passageway section, the vapor-permeable membrane, the liquid refrigerant reservoir, and the actuator.

In addition to including a wicking material, other embodiments of the present invention include: a heat-removing material, which may be a phase-changing material, in thermal contact with the sorbent; at least one liquid barrier between the heat-removing material and the sorbent; and at least one thermal spacer positioned between the sorbent section and the liquid passageway section. In some embodiments, the thermal spacer is interposed between the sorbent section and the vapor-permeable membrane. In other embodiments, the thermal spacer is interposed between the vapor-permeable membrane and the liquid passageway section. In another embodiment (FIG. 10) there is no wicking material, nor vapor permeable membrane, but rather an anisotropic insulation material hydrophobic on one side and hydrophilic on the other replaces the functions of those components. Furthermore, some embodiments include casings made from a flexible material such as a metallicized plastic.

A feature of the present invention is that it is compact and lightweight. The invention is designed to fit within a host container, i.e., a beverage container. An additional feature of the invention, related to its compact size, is the short vapor path between the liquid refrigerant reservoir and the sorbent. The vapor path is at most several millimeters.

Other features and advantages of the present invention will be set forth, in part, in the description which follows and the accompanying drawings, wherein the preferred embodiments of the present invention are described and shown, and in part will become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE DRAWINGS

FIG. 1 is a top plan view, partially cut away, of a cooling device in accordance with the invention.

FIG. 3 is a plan view of a beverage container with the beverage and the cooling device of FIG. 1 shown in phantom.

DETAILED DESCRIPTION OF THE PREFERRED EMBODIMENTS

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Certain terminology will be used in the following specification for convenience in reference only and will not be limiting. For example, the word "absorption" refers to the occurrence of a substance (e.g., water vapor) penetrating the inner structure of another (the absorbent). Also, the word "adsorption" refers to the occurrence of a substance (e.g., water vapor) being attracted and held onto the surface of another (the adsorbent). The words "absorption" and "adsorption" include derivatives thereof. The word "sorbent" refers to a material that is either an absorbent and/or an adsorbent.

Figure 2A:
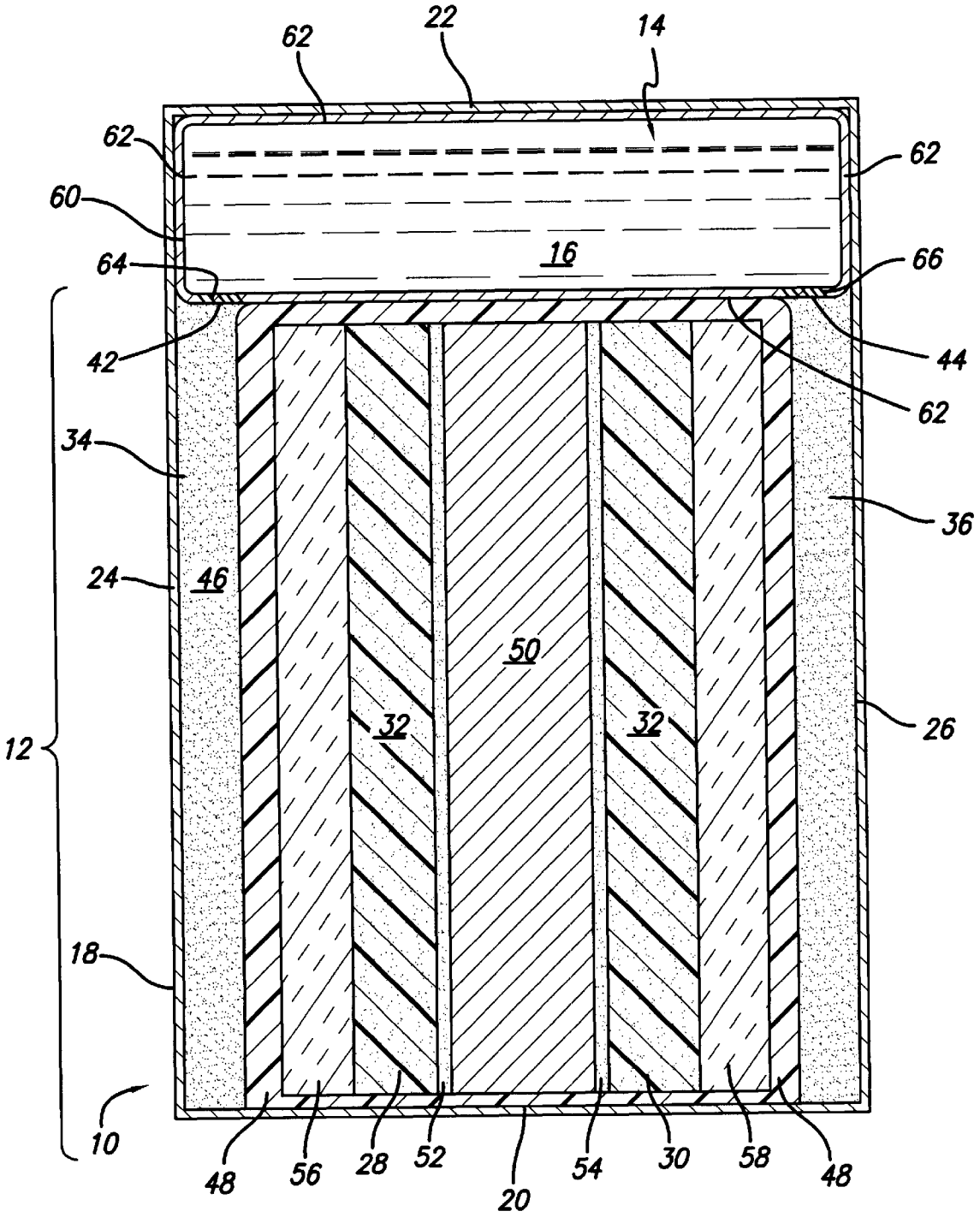
FIG. 2A is a sectional view of the cooling device of FIG. 1 showing details of a sorbent chamber and a liquid refrigerant reservoir.

The evacuated sorbent assembly and cooling device is shown in the exemplary drawings. With particular reference to FIGS. 1, 2A and B, there is shown a cooling device 10 housing an evacuated sorbent assembly 12 adjacent a liquid refrigerant reservoir 14, which contains a liquid refrigerant 16. The cooling device includes an evacuable casing 18, with opposing ends 20 and 22, and opposing sides 24 and 26. The casing is substantially impervious to air and moisture so as to provide the cooling device with a suitable shelf-life (to allow for several years of storage/inactivation prior to use). Useful casing materials have an oxygen transmission rate (OTR) preferably less than about 1 $cm^3/m^2/day$, more preferably less than 0.1 $cm^3/m^2/day$, and most preferably less than 0.01 $cm^3/m^2/day$. The vapor transmission rate of useful casing materials is preferably less than about 2 $g/m^2/day$, more preferably less than 1 $g/m^2/day$, and the most preferably less than about 0.1 $g/m^2/day$.

The casing 18 is made from a flexible material such as a metallicized plastic laminate or a metal foil plastic laminate. Suitable casing materials include flexible films such as those produced by the Rexam Corporation located in Bedford Park, Ill., and Toyo Aluminum located in Osaka, Japan. The flexibility of the cooling device allows it to be deformed without losing its performance characteristics. For example, the cooling device may be curled and then placed within a beverage container without any degradation in its cooling abilities.

A sectional view of the cooling device 10 is shown in FIGS. 2A and B. Included in the evacuated sorbent assembly 12 are a pair of sorbent sections 28 and 30 in which a sorbent 32 is disposed. The sorbent preferably includes an absorbent material dispersed on, impregnated in, affixed to, or otherwise combined with the porous support material. The porous support material preferably has a high pore volume, and therefore a high surface area, to accommodate the absorption of large amounts of liquid refrigerant 16, in vapor form, by the sorbent. The pore volume is expressed in units of volume per unit mass. The porous support material has a pore volume of at least about 0.8 cc/g, more preferably at least about 1 cc/g, and even more preferably at least about 1.5 cc/g.

In order to accommodate high absorption levels of liquid refrigerant 16, it is also important to control the average pore diameter and pore size distribution of the porous support material. The average pore diameter is preferably at least about 1 nanometer, and typically in the range from about 1 to about 20 nanometers. The average pore diameter distribution is such that there are very few pores having a diameter of less than about 0.5 nanometers. The porous support material can be selected from virtually any material having the above-identified properties. Preferred materials for the porous support material include activated carbon and silica.

The porous support material can come in a variety of shapes and sizes selected for a particular application. For example, in some embodiments, the porous support material is comprised of small activated carbon pellets having a size in the range of from about 0.5 to 2 millimeters. In alternative embodiments, the porous support material is silica pellets having a size from about 0.25 to 0.5 millimeters. The size of the pellets can be selected to influence the rate at which the vapor from the liquid refrigerant 16 is absorbed. Larger pellets absorb liquid refrigerant vapor at a slower rate due to increased path length.

It is preferred that the absorbent material have a pore volume that is at least about50 percent of the pore volume of the porous support material, and even more preferably at least about 66 percent of the pore volume of the porous support material. That is, it is preferred that if the pore volume of the porous support material is about 1.5 cc/g, then the pore volume of the absorbent material is preferably no less than about 0.75 cc/g, more preferably no less than about 1.0 cc/g.

When the liquid refrigerant 16 is water, the absorbent material is preferably capable of absorbing at least about 100 percent of its weight in water, more preferably at least about 150 percent of its weight in water, and even more preferably at least about 200 percent of its weight in water. The amount of water that can be absorbed will also be influenced by the relative humidity and temperature.

Any suitable absorbent material can be used. Representative absorbent materials include salts such as calcium chloride, lithium chloride, lithium bromide, magnesium chloride, calcium nitrate, and potassium fluoride. Other suitable absorbent materials include phosphorous pentoxide, magnesium perchlorate, barium oxide, calcium oxide, calcium sulfate, aluminum oxide, calcium bromide, barium perchlorate, and copper sulfate, zeolite 13x, zeolite 5a, silicalite, silica gel, alumina, carbon, modified carbons and the like. Furthermore, the absorbent material may also contain combinations of two or more of these materials.

Adjacent to each sorbent section 28 and 30 are liquid passageway sections 34 and 36, respectively, defining liquid passageways 38 and 40, respectively, through at least-a portion of the evacuated adsorbent assembly 12. A pair of actuators 42 and 44 control the flow of liquid refrigerant 16 from the liquid refrigerant reservoir 14 into the liquid passageway sections. In some embodiments, the actuators are mechanically activated. In other embodiments the actuators are pressure activated such that a change in pressure causes the actuators to open and permit communication between the liquid refrigerant reservoir and the liquid passageway sections.

In the embodiment shown in FIG. 2A, a wicking material 46 is placed within the liquid passageway sections 34 and 36. The wicking material draws liquid refrigerant 16 from the liquid refrigerant reservoir 14 and retains the liquid refrigerant for subsequent vaporization and adsorption by the sorbent 32. In addition, the wicking material absorbs any vaporized liquid refrigerant in the liquid passageway sections that re-condenses before reaching the sorbent. When the liquid refrigerant is water, suitable wicking materials include hydrophilic materials such as microporous metals, porous plastics (polyethylene, polypropylene), cellulose products, sintered heat pipe material, or glass paper, and the like.

No more wicking material 46 is required than is necessary to draw all of the liquid refrigerant 16 to be adsorbed in the evacuated sorbent assembly 12. The wicking material has a pore size sufficient to permit capillary action (the drawing of all the liquid refrigerant from the liquid refrigerant reservoir 14) to occur within 60 seconds, and most preferably, within 10 seconds after actuation.

Figure 4:
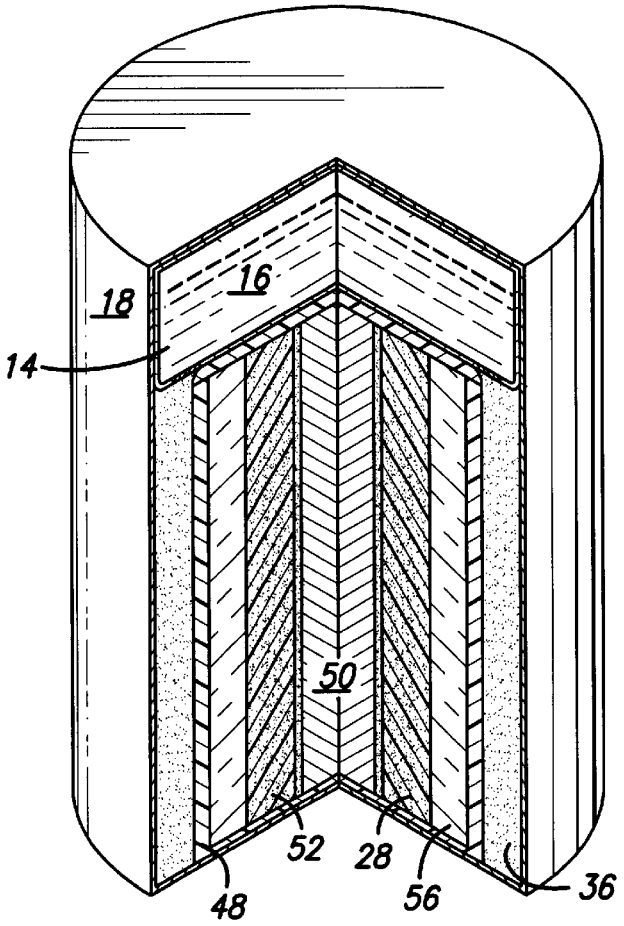
FIG. 4 is a perspective view, partially cut away, of a second alternative embodiment of a cooling device in accordance with the invention.
Figure 5:
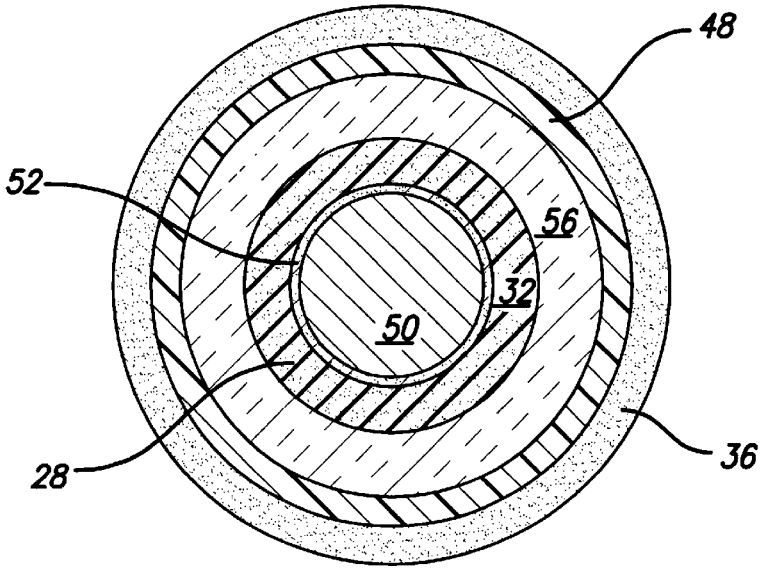
FIG. 5 is a sectional view of the cooling device of FIG. 4.

In the embodiments shown in FIGS. 4 and 5, the wicking material 46 provides a direct interface between the liquid refrigerant 16 and the sorbent 32. In these embodiments, the wicking material maintains and holds the liquid refrigerant until it is vaporized and later adsorbed by the sorbent. Sufficient wicking material is used so that non-vaporized liquid refrigerant does not directly contact the sorbent.

Also seen in the embodiment shown in FIG. 2A is a vapor-permeable membrane 48 separating sorbent sections 28 and 30 and adjacent liquid passageway sections 34 and 36. The vapor-permeable membrane is semi-permeable such that only vaporized liquid refrigerant 16 may pass through it to be adsorbed by the sorbent 32. In some embodiments, the vapor-permeable membrane is a substantially flat film that is heat-sealed or sealed by an adhesive so as to encase the sorbent and to prevent liquid from contacting the sorbent within the vapor-permeable membrane. Useful vapor-permeable membranes include semi-permeable films such as films available under the trademark TYVEK® produced by the E.I. DuPont de Nemours, Wilmington, Del., and films available under the trademark GORETEX® produced by the R.L. Gore Company, Newark, Del. In other embodiments of the present invention, the vapor-permeable membrane is not substantially flat, but is corrugated or otherwise shaped so as to increase surface area and thereby the rate at which vaporized liquid refrigerant passes through the membrane.

Alternatively, the vapor-permeable membrane 48 may be a hydrophobic coating applied to one or both of the surfaces of the sorbent sections 28 and 30 and the liquid passageway sections 34 and 36 which are facing one another. Suitable hydrophobic coatings include those available under the trademark SCOTCHGARD® produced by 3M, St. Paul, Minn.

As there can be large temperature differences between the wicking material 46 and the sorbent sections 28 and 30, in some embodiments thermal spacers 56 and 58 are interposed between the sorbent sections and the vapor-permeable membranes 48 or between the sorbent sections and the wicking material. The thermal spacers are utilized to insulate heat generated by the sorbent 32. Since the temperature between the wicking material and sorbent sections can vary from 5° C. to 150° C., the thermal spacers have a thermal resistance (thermal conductivity at package conditions divided by thickness) preferably less than 100 $W/m^2K$, more preferably less than50 $W/m^2K$, and most preferably less than 20 $W/m^2K$. The materials utilized for the thermal spacers can be selected from a range of materials known to the art that provide sufficient vapor permeability such as fiberglass, plastic fibers, and plastic foams.

Figure 2B:
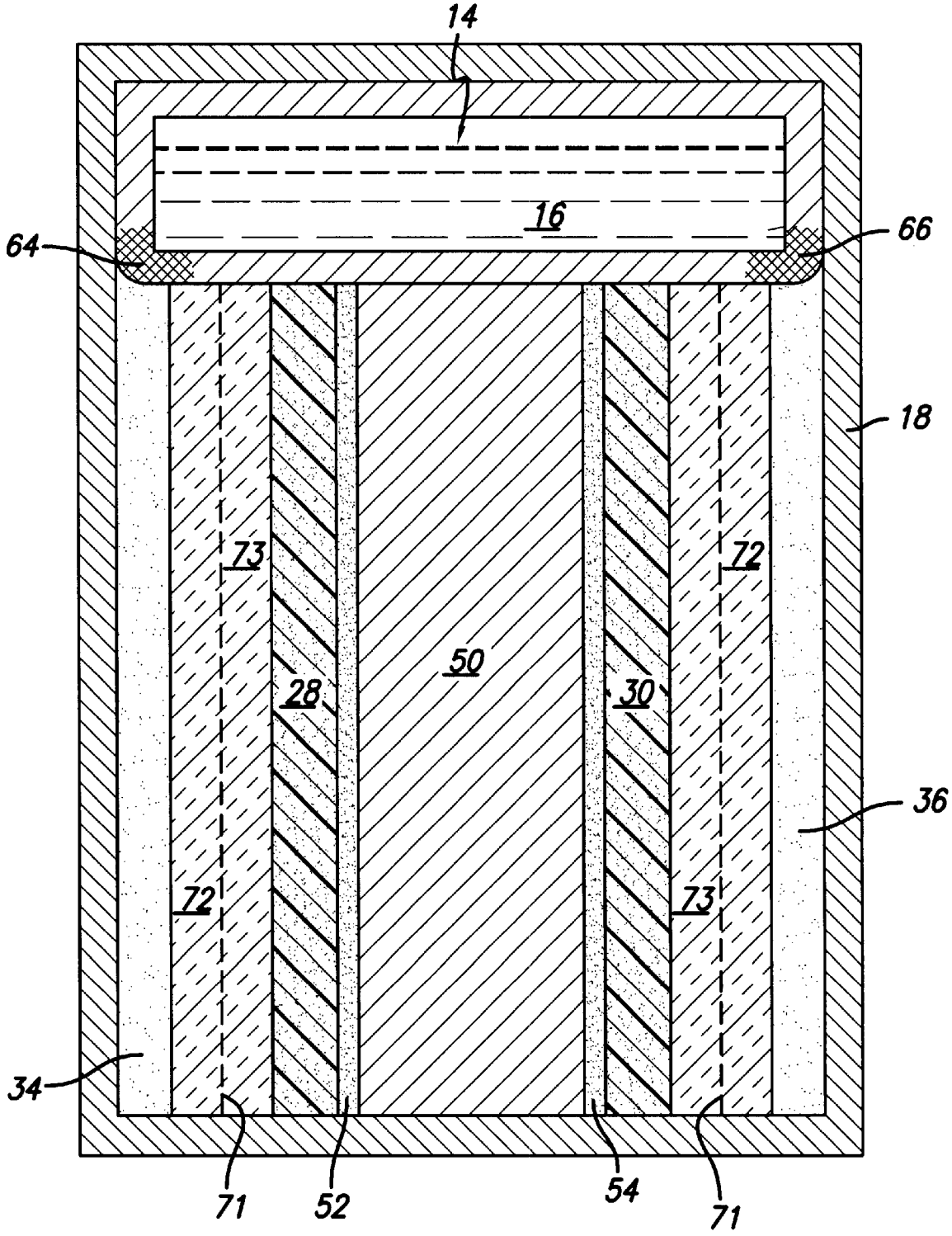
FIG. 2B is a sectional view of a first alternative embodiment of a cooling device in accordance with the invention.

As shown in the alternative embodiment illustrated in FIG. 2B, an insulating material 71 is placed between the sorbent sections 28 and 30 and adjacent liquid passageway sections 34 and 36 replacing the wicking material 46, thermal spacers 56 and 58, and the vapor-permeable membrane 48 shown in the embodiment illustrated in FIG. 2A. The insulating material 71 is chosen to inhibit thermal leakback from the sorbent sections 28 and 30 to the exterior of the device. Typically, the insulating material has thermal conductivity limits less than 0.05 W/mK, preferably less than about 0.035 W/mK, and most preferably, less than about 0.025 W/mK. Preferably, the insulating material 71 has a collapse strength sufficient to resist about one bar uniaxial load, and limit the shrinkage, due to evacuation, to less than about 20%, more preferably less than about 5%, and most preferably less than about 2%.

In some embodiments, an anisotropic insulating material containing both a hydrophilic region 72 and a hydrophobic region 73 is preferred. Such an insulating material inhibits the passage of liquid refrigerant 16 into the sorbent sections 28 and 30, yet allows the vapor of the liquid refrigerant to pass into the sorbent sections 28 and 30.

The hydrophilic region 72 of the insulating material has pores with a relatively large diameter, not less than 10 mm in diameter, on average. The large pores of the hydrophilic region 72 encourage the rapid flow of liquid refrigerant 16 into the material. The hydrophobic region 73 has pores of a relatively small diameter, typically less than about 2 mm in diameter, so that the un-vaporized liquid refrigerant 16 is inhibited from passing into the sorbent section 28 and 30, but rather only the vapor from the liquid refrigerant 16 is directed into the sorbent section 28 and 30.

The ratio of the thickness of the hydrophobic region 73 to hydrophilic region 72 is a function of the choice of materials used to form those regions, the quantity of liquid refrigerant 16 in the device, and the desired performance criteria of the device.

The insulating material 73 can be formed by laminating a hydrophilic material such as cellulose, paper, non-woven or woven cloth formed from fibers of glass, plastic, ceramic or cellulose, to a hydrophobic material. The hydrophobic material can be made by modifying a hydrophilic material with a hydrophobic agent, such as by impregnating a hydrophilic material with wax or adding a hexamethyldisiliazane or a flourinated reactive group to the hydrophilic material.

Alternatively, the insulating material can be formed by surface modification, whereby a sheet of material (either hydrophilic or hydrophobic) is modified to change the surface on one side. In general, the surface of one side of a hydrophobic material can be made hydrophilic by exposure to thermal or plasma treatments or by impregnation with surfactants. The surface of a hydrophilic material can be made hydrophobic by treatment with hydrophobing agents or impregnation of wax-like material.

The evacuated sorbent assembly 12 can also contain a heat-removing material 50 in thermal contact with the sorbent sections 28 and 30. The heat-removing material is placed adjacent to the surface of the sorbent section(s) opposite the vapor-permeable membrane 48. The heat-removing material is one of three types: (1) a material that undergoes a change of phase when heat is applied (phase-change material); (2) a material that has a heat capacity greater than the sorbent 32; or (3) a material that undergoes an endothermic reaction when brought in contact with a vaporized liquid refrigerant 16. It will be understood by the skilled artisan that the heat-removing material, for use in a particular application may vary depending on the sorbent utilized, the thermal insulation, if any, between the phase-change material, the liquid refrigerant, and the desired cooling rate.

Suitable heat-removing materials 50 include paraffin, naphthalene sulphur, hydrated calcium chloride, bromocamphor, cetyl alcohol, cyanamide, eleudic acid, lauric acid, hydrated calcium silicate, sodium thiosulfate pentahydrate, disodium phosphate, hydrated sodium carbonate, hydrated calcium nitrate, neopentyl glycol, hydrated inorganic salts including Glauber's salt, inorganic salts encapsulated in paraffin, hydrated potassium and sodium sulfate, and hydrated sodium and magnesium acetate. The preferred heat-removing material is an inorganic salt that has been melted and re-solidified to form a monolith (thereby reducing the volume of the heat-removing material by approximately 30%).

The heat-removing material 50 removes some of the heat from the sorbent sections 28 and 30 simply through the storage of sensible heat, because the heat-removing material heats up as the sorbent sections heat up, thereby removing heat from the sorbent sections. However, the most effective heat-removing material typically undergoes a change of phase. A large quantity of heat is absorbed in connection with a phase change (i.e., change from a solid phase to a liquid phase, change from a solid phase to part solid phase and part liquid phase, or change from a liquid phase to a vapor phase). During the phase change, there is typically little change in the temperature of the heat-removing material, despite the relatively substantial amount of heat absorbed to effect the change.

Another requirement of phase-change heat-removing material 50 is that it change phase at a temperature greater than the expected ambient temperature of the material to be cooled, but less than the temperature achieved by the sorbent sections 28 and 30 upon absorption of a substantial fraction (i.e., one-third or one-quarter) of the liquid refrigerant 16. For example, when the current invention is employed in a cooling device 10 for insertion into a typical beverage container, the phase change should take place at a temperature above about 30° C., preferably above about 35° C. but preferably below about 70° C., and most preferably below about 60° C.

When absorbing heat, a phase-change heat-removing material 50 may generate by-products such as water, aqueous salt solutions, and organics. Therefore, depending on the particular heat-removing material utilized, in some embodiments it is desirable to include liquid barriers 52 and 54, such as polyethlene or polypropylene film, interposed between the sorbent sections 28 and 30, respectively, and the heat-removing material to prevent any by-products from contacting the sorbent 32 (and thereby decreasing its effectiveness). The liquid barriers are heat sealed or adhesively sealed to the heat-removing material.

The liquid refrigerant reservoir 14 is positioned immediately adjacent one end 22 of the casing 18. This arrangement provides an advantage over prior art sorbent chambers that typically employ devices with long vapor paths which decrease the effectiveness of the vaporization of the liquid refrigerant 16. In addition, the short vapor paths allow the evacuated sorbent assembly 12 to operate at a much higher pressure level than previous sorbent assemblies.

In some embodiments, the liquid refrigerant reservoir 14 is a plastic 60, typically made of polyethylene, that is filled and heat sealed along its edges 62 enclosing the liquid refrigerant 16. Weakened portions 64 and 66 of the plastic bag serve as pressure sensitive actuators 42 and 44.

The liquid refrigerant 16 stored in the liquid refrigerant reservoir 14 has a high vapor pressure at ambient temperature so that a reduction of pressure will produce a high vapor production rate. In addition, the liquid refrigerant has a high heat of vaporization. The vapor pressure of the liquid refrigerant at 20° C. is typically at least about 9 mm Hg, preferably at least about 15 or 20 mm Hg. Suitable liquid refrigerants include various alcohols, such as methyl alcohol or ethyl alcohol; ketones or aldehydes such as acetone and acetaldehyde; and hydrofluorocarbons such as C318, 114, 21, 11, 114B2, 113, 112, 134A, 141B, and 245FA. The preferred liquid refrigerant is water because it is plentiful and does not pose any environmental problems while providing the desired cooling characteristics.

In some embodiments, the liquid refrigerant 16 is mixed with an effective quantity of a miscible nucleating agent (or a partial miscible nucleating agent) having a greater vapor pressure than the liquid refrigerant to promote ebullition so that the liquid refrigerant evaporates even more quickly and smoothly, while preventing the liquid refrigerant from supercooling and thereby decreasing the adsorption rate in the sorbent 32. Suitable nucleating agents include ethyl alcohol, acetone, methyl alcohol, isopropyl alcohol and isobutyl alcohol, all of which are miscible with water. For example, a combination of a nucleating agent with a compatible liquid might be a combination of 5% ethyl alcohol in water or 5% acetone in methyl alcohol. The nucleating agent preferably has a vapor pressure at 25° C. of at least about 25 mm Hg, and, more preferably, at least about 35 mm Hg. Alternatively, a solid nucleating agent may be used, such as a conventional boiling stone used in chemical laboratory applications.

During manufacturing, the sorbent sections 28 and 30 are inserted into the casing 18 along with the liquid refrigerant reservoir 14 prior to heat sealing the casing. Depending upon the embodiment, wicking material 46 is placed adjacent the sorbent sections and encased with a vapor-permeable membrane 48. Furthermore, in some embodiments, the vapor-permeable membrane also encases a layer of heat-removing material 50 in thermal contact with the sorbent 32, liquid barriers 52 and 54 interposed between the heat-removing material and the sorbent sections, respectively, and thermal spacers 56 and 58 interposed between the sorbent sections and the liquid passageway sections 34 and 36, respectively. Specifically, the thermal spacers may be interposed between the sorbent sections and the vapor-permeable membrane or between the vapor-permeable membrane and the liquid passageway sections. In other embodiments, insulating material 71 is placed between the sorbent sections and liquid passageway sections 34 and 36. Next, the opposing ends 20 and 22 and at least one of the opposing sides 24 and 26 are heat sealed after evacuation to greater than 1 mm Hg. In alternative embodiments, the casing is sealed with an adhesive.

The method of use and operation of the evacuated sorbent assembly 12 and cooling device 10, constructed as described above, proceeds as follows. Initially, the actuators 42 and 44 are actuated causing the liquid refrigerant 16 to flow into the liquid passageways 38 and 40. In the embodiments of the invention where the liquid refrigerant reservoir 14 is a plastic bag 60 with weakened portions 64 and 66, external pressure is applied to the casing 18 and liquid refrigerant reservoir. The external pressure ruptures the weakened portions 64 and 66 and releases the liquid refrigerant into the liquid passageways.

Liquid refrigerant 16, except for a small amount that is instantly vaporized, is introduced into the evacuated adsorbent assembly 12 from the liquid refrigerant reservoir 14 via the liquid passageways 34 and 36. Depending upon the embodiment of the invention, the liquid refrigerant collects in very thin layers among the interstices of the wicking material 46. The vaporized liquid refrigerant then passes through the vapor-permeable membrane 48, and enters the sorbent sections 28 and 30 where the vaporized liquid refrigerant is adsorbed by the sorbent 32. Alternatively, the liquid refrigerant collects in the hydrophilic region of the insulation material. The vaporized refrigerant then passes through the hydrophilic region 73 and absorbent sections 28 and 30. As the sorbent adsorbs vaporized liquid refrigerant, the liquid refrigerant collected within the wicking material begins to vaporize and pass through the vapor-permeable membrane into the sorbent.

Vaporization of the liquid refrigerant 16 causes a cooling effect on the outside of the cooling device 10 which, as shown in FIG. 3 can be used to cool a beverage 80 in a beverage container 82. Less than 1.5 grams of liquid refrigerant water per fluid ounce of beverage, less than 3 grams of sorbent 32 per fluid ounce of beverage, and less than 5 cubic centimeters of sorbent 32 per fluid ounce of beverage is required to cool the beverage by 22° C. in preferably less than 10 minutes, more preferably less than 5 minutes, and most preferably less than 3 minutes after actuation. Also, the cooling device occupies less than 0.5 fluid ounces per fluid ounce of beverage.

Those skilled in the art will recognize that various modifications and variations can be made in the evacuated sorbent assembly 12 and cooling device 10 of the invention and in the construction and operation of the evacuated sorbent assembly and cooling device without departing from the scope or spirit of this invention. For example, the evacuated sorbent assembly may be used as part of a cooling device which may be wrapped around the outer circumference of a beverage container rather than being placed therein. In addition, the sorbent assembly need not be symmetrical, but rather, it can be asymmetrical and arranged, for example, such that the layer adjacent the casing 18 is the sorbent section 28, with the next layer being the vapor-permeable membrane 48, and with the final layer being the wicking material 46.

Figure 6:
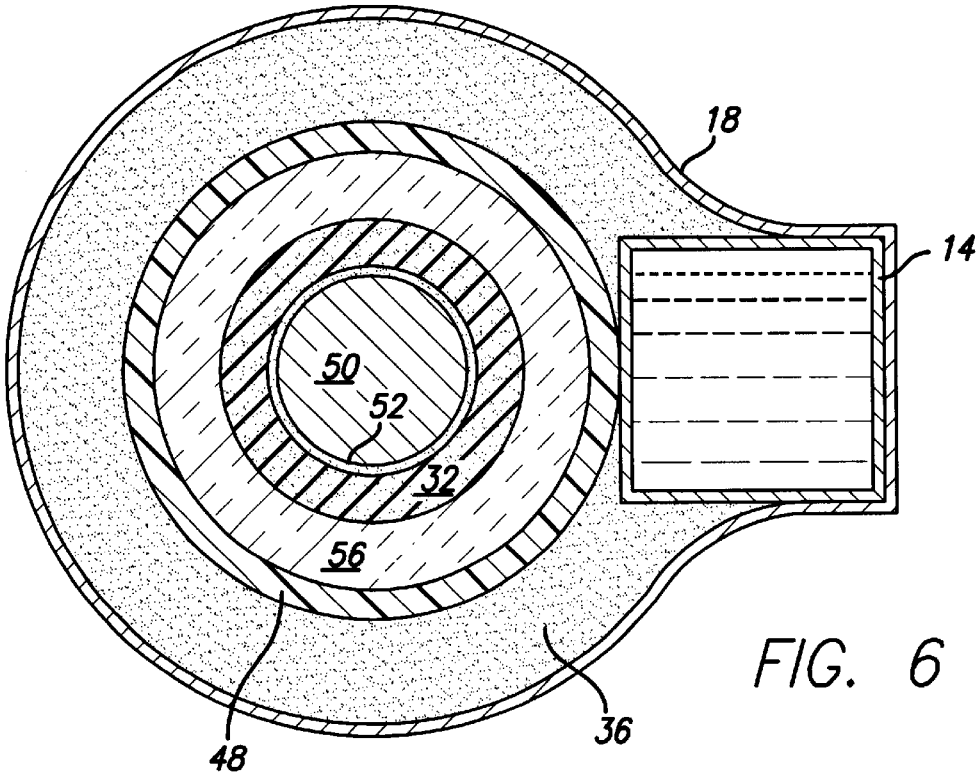
FIG. 6 is a sectional view of a third alternative embodiment of a cooling device in accordance with the invention.
Figure 7:
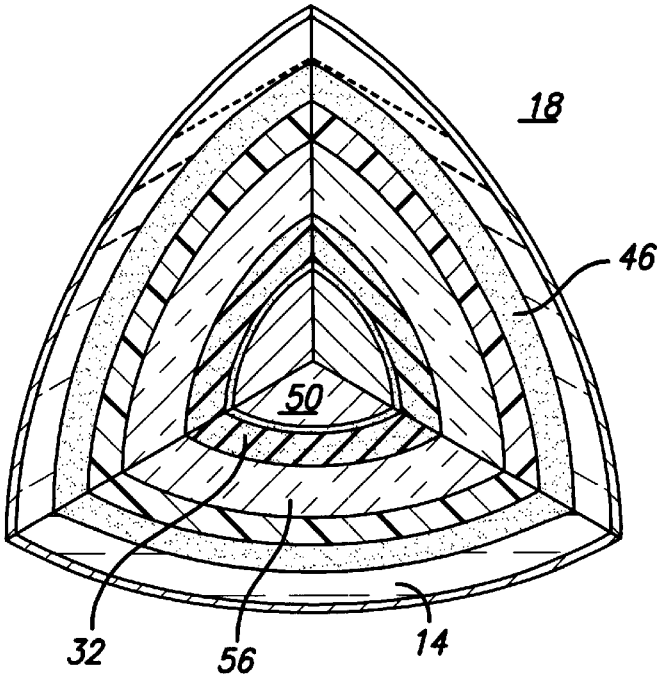
FIG. 7 is a perspective view, partially cut away, of a fourth alternative embodiment of a cooling device in accordance with the invention.
Figure 8:
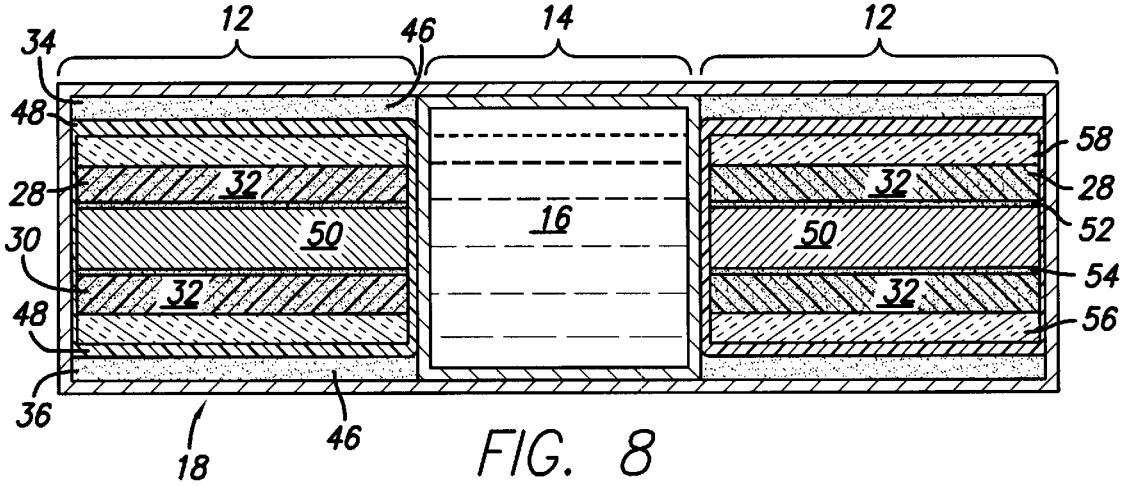
FIG. 8 is a sectional view of a fifth alternative embodiment of a cooling device in accordance with the invention.
Figure 9:
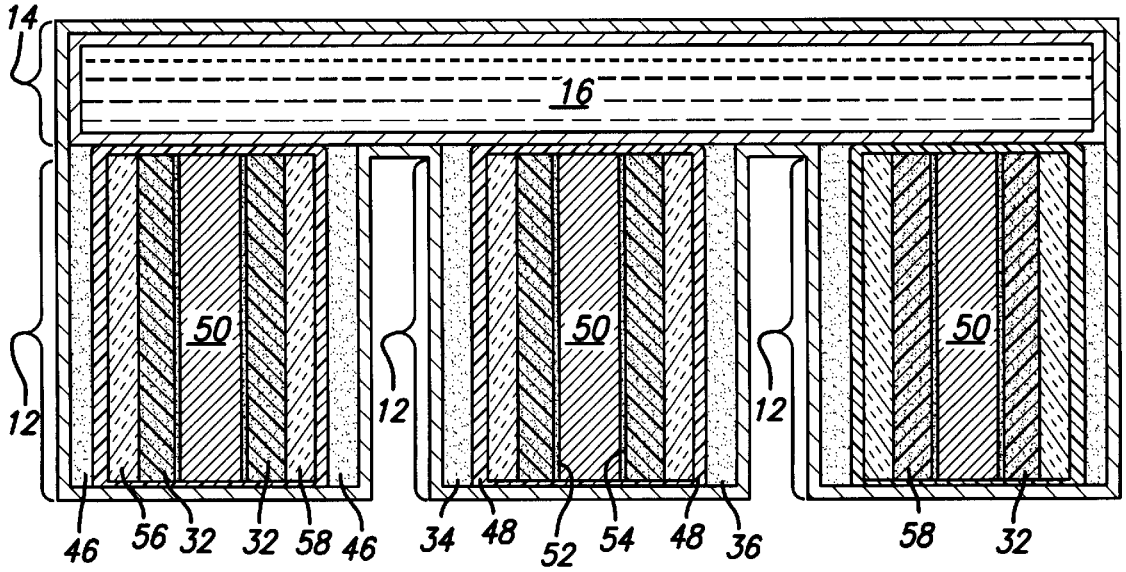
FIG. 9 is a sectional view of a sixth alternative embodiment of a cooling device in accordance with the invention.

Also, the sorbent assembly and cooling device can be arranged in a spherical configuration as shown in FIGS. 4, 5, and 6. In the embodiment shown in FIG. 6, the liquid refrigerant reservoir 16 is adjacent the length of the evacuated sorbent assembly 12. FIG. 7 shows another embodiment of the present invention where the evacuated sorbent assembly has a polygonal cross-section. In other embodiments, as shown in FIGS. 8 and 9, two or more evacuated sorbent assemblies are adjacent to a single liquid refrigerant reservoir.

Figures 10, 11, 12, 13:
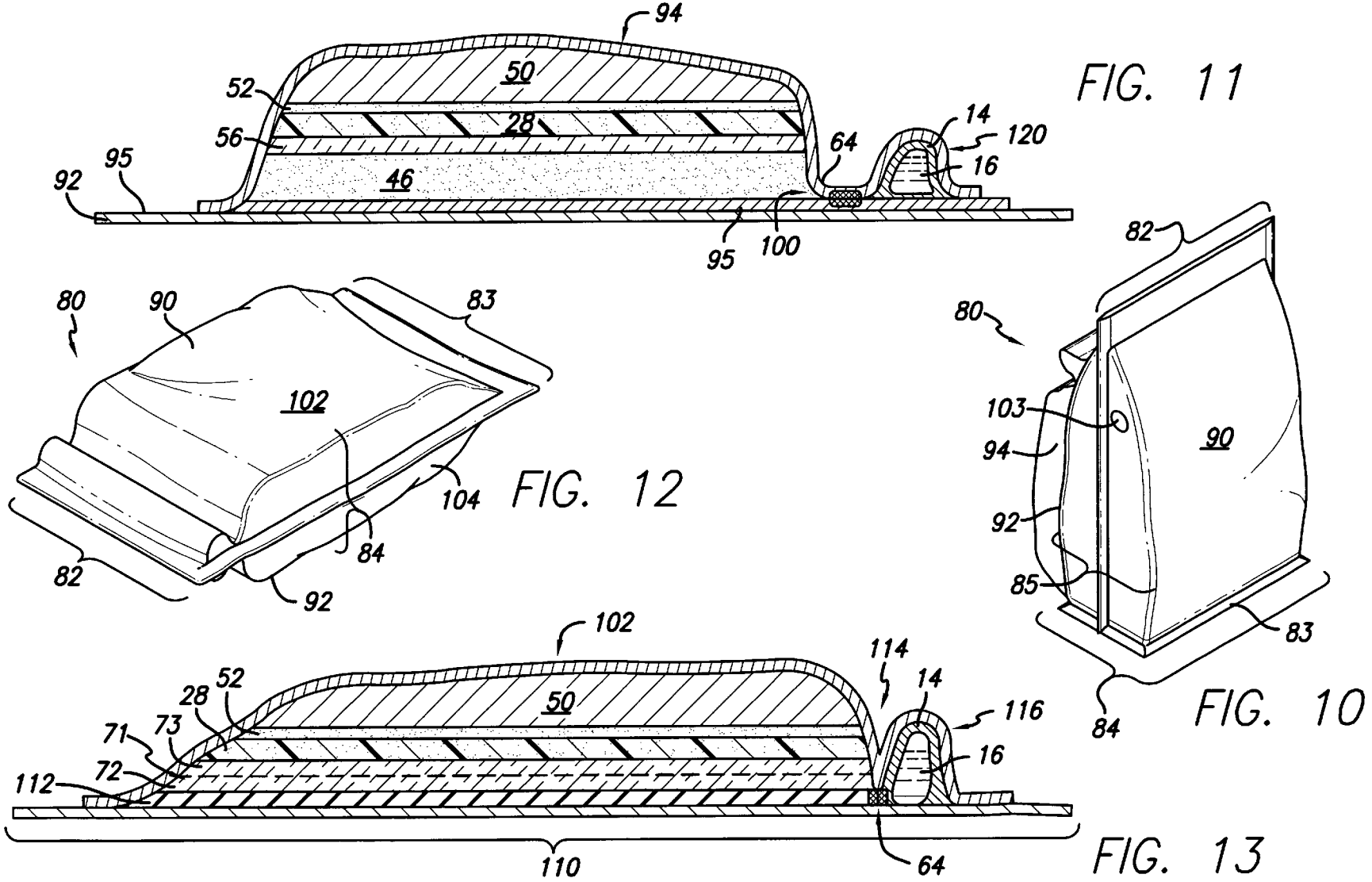
FIG. 10 is a perspective view of a beverage container pouch containing a single cooling device in accordance with the invention.
FIG. 11 is a cross sectional view of the front surface and the cooling device of the pouch shown in FIG. 10.
FIG. 12 is a perspective view of an alternative beverage container pouch containing two cooling devices in accordance with the invention.
FIG. 13 is a cross sectional view of the front surface and the cooling device of the pouch shown in FIG. 12.

FIG. 10 shows a conventional beverage container pouch 80 constructed of a plastic-lined, metallicized material, which is heat-sealable. The pouch has a top end 82, a bottom end 83 formed by panel 84, to create a base for the beverage container pouch, opposing side panels (one shown) 85, and opposing front and back panels, 90 and 92, respectively. A single coolant device 94 is formed as part of, or affixed to the exterior surface of the front panel. In an alternative embodiment, the coolant device may be formed as part of, or affixed to the interior surface of the panel.

As best seen in FIG. 11, the coolant device 94 is affixed to the exterior surface 95 of the front panel 92 of the pouch 80 by securing the exterior 95 of the coolant device to the exterior surface of the front panel 90 with the wicking material 46 facing the pouch 80. Adjacent to the interior surface of the affixed coolant device is the liquid passageway 36 containing the wicking material 46. The cooling device casing material is sealed 100 to a portion of the wicking material 46 to form a cavity 102 housing the liquid refrigerant 16 and the liquid refrigerant reservoir 14 including actuator 64. On the other side of the wicking material is a thermal spacer 56, followed by the sorbent material 28, the liquid barrier 52, and, finally, the heat-removing material 50. In practice, the user squeezes the portion of casing defining the liquid refrigerant cavity to actuate the actuator 64 and release the liquid refrigerant 16 into the liquid passageway. A weakened region 103 in the pouch (FIG. 10) forms an area adapted to be punctured by a plastic straw.

FIG. 12 shows a conventional beverage container pouch 80 constructed of a plastic-lined, metallicized material, which is heat-sealable. The pouch has a top end 82, a bottom end 83, opposing side panels (one shown), 84, and opposing front and back panels, 90 and 92, respectively. A brace of coolant devices 102 and 104 are formed as part of, or may be affixed to the front and back panels 90 and 92. In an alternative embodiment, the coolant devices are formed as part of, or may be affixed to the interior surface of the panels.

As shown in FIG. 13 for one of the coolant devices, the coolant device 102 is formed as part of the pouch 80 by constructing a wall of the cooling device from a portion 110 of the front panel 90. Adjacent to the interior surface of the wall 110 of the wall of the coolant device is a capillary membrane 112 that provides a liquid passageway from the liquid refrigerant reservoir 14 throughout the length of the sorbent assembly. The cooling device casing material is sealed 114 to a portion of the capillary membrane 112 material to form a cavity 116 housing the liquid refrigerant reservoir 14 including actuator 64. On the other side of the capillary membrane, is an insulating material 71, having hydrophilic and hydrophobic surfaces 72 and 73, respectively, followed by the sorbent material 28, the liquid barrier 52, and finally, the heat removing material 50.

Embodiments of the cooling device decrease the temperature of a beverage in a beverage container by at least about 12° C. and in some embodiments at least 15° C. or even 20° C. after actuation. In these embodiments, the liquid refrigerant reservoir contains less than 1.5 grams of liquid refrigerant per fluid ounce of beverage in the container. In some embodiments, the refrigerant liquid is water. Also, in some embodiments, the sorbent section has a mass of less than 3 grams of sorbent per fluid ounce of beverage. Depending upon the embodiment, the cooling device may decrease the beverage temperature in 10 minutes, or only 5 minutes, or even only 3 minutes. In some embodiments, the sorbent section occupies less than 5 cubic centimeters per fluid ounce of beverage, and the cooling device occupies less than 0.5 fluid ounces per fluid ounce of a beverage in a beverage container.

With such possibilities in mind, the invention is defined with reference to the following claims.

We claim:

1. An evacuated sorbent assembly for coupling to a liquid refrigerant reservoir comprising:

at least one sorbent section, the sorbent section containing a sorbent for a liquid refrigerant;

at least one liquid passageway section adjacent the sorbent section, the liquid passageway section defining a liquid passageway through at least a portion of the evacuated sorbent assembly to the sorbent section, the liquid passageway containing sufficient wicking material to prevent the liquid refrigerant from contacting the sorbent; and an actuator for controlling liquid communication between the liquid passageway section and the liquid refrigerant reservoir.

2. The evacuated sorbent assembly of claim 1, further comprising a heat-removing material in thermal contact with the sorbent.

3. The evacuated sorbent assembly of claim 2, wherein the heat-removing material is a phase-change material.

4. The evacuated sorbent assembly of claim 2, further comprising at least one liquid barrier interposed between the heat-removing material and the sorbent.

5. The evacuated sorbent assembly of claim 1, further comprising at least one thermal spacer interposed between the sorbent section and the liquid passageway section.

6. The evacuated sorbent assembly of claim 1, wherein the sorbent section is supported on a flexible monolith.

7. An evacuated sorbent assembly for coupling to a liquid refrigerant reservoir comprising:

at least one sorbent section containing a sorbent for a liquid refrigerant;

at least one liquid passageway section adjacent the sorbent section, the liquid passageway section defining a liquid passageway through at least a portion of the evacuated sorbent assembly to the sorbent section;

a vapor-permeable membrane separating adjacent sorbent and liquid passageway sections; and an actuator for controlling liquid communication between the liquid passageway section and the liquid refrigerant reservoir.

8. The evacuated sorbent assembly of claim 7, further comprising a heat-removing material in thermal contact with the sorbent.

9. The evacuated sorbent assembly of claim 8, wherein the heat-removing material is a phase-change material.

10. The evacuated sorbent assembly of claim 8, further comprising at least one liquid barrier interposed between the heat-removing material and the sorbent.

11. The evacuated sorbent assembly of claim 7, further comprising at least one wicking material disposed in the liquid passageway section.

12. The evacuated sorbent assembly of claim 7, further comprising at least one thermal spacer interposed between the sorbent section and the vapor-permeable membrane.

13. The evacuated sorbent assembly of claim 7, further comprising at least one thermal spacer interposed between the vapor-permeable membrane and the liquid passageway section.

14. The evacuated sorbent assembly of claim 7, wherein the sorbent section is supported on a flexible monolith.

15. A cooling device comprising:

a casing surrounding at least one sorbent section containing a sorbent for a liquid refrigerant;

at least one liquid passageway section adjacent the sorbent section, the liquid passageway section defining a liquid passageway through at least a portion of the cooling device to the sorbent section;

a vapor-permeable membrane separating adjacent sorbent and liquid passageway sections;

a liquid refrigerant reservoir adjacent the liquid passageway section; and an actuator for controlling liquid communication between the liquid passageway section and the liquid refrigerant reservoir.

16. The cooling device of claim 15, further comprising a heat-removing material in thermal contact with the sorbent and surrounded by the casing.

17. The cooling device of claim 16, wherein the heat-removing material is a phase-change material.

18. The cooling device of claim 16, further comprising at least one liquid barrier interposed between the heat-removing material and the sorbent and surrounded by the casing.

19. The cooling device of claim 15, further comprising at least one wicking material disposed in the liquid passageway section.

20. The cooling device of claim 15, further comprising at least one thermal spacer interposed between the sorbent section and the vapor-permeable membrane and surrounded by the casing.

21. The evacuated sorbent assembly of claim 15, wherein the sorbent section is supported on a flexible monolith.

22. The cooling device of claim 17, further comprising at least one thermal spacer interposed between the vapor-permeable membrane and the liquid passageway section and surrounded by the casing.

23. The cooling device of claim 16, wherein the casing is made from a flexible material.

24. The cooling device of claim 23, wherein the flexible material is metallicized plastic.

25. The cooling device of claim 15, wherein the cooling device decreases the temperature of a beverage in a beverage container by at least 22° C. after actuation, the sorbent section having a mass of less than 3 grams per fluid ounce of beverage, the liquid refrigerant reservoir containing less than 1.5 grams of liquid refrigerant per fluid ounce of beverage.

26. The cooling device of claim 25, wherein the liquid refrigerant is water.

27. The cooling device of claim 25, wherein the beverage temperature decreases by at least 22° C. in less than 10 minutes.

28. The cooling device of claim 25, wherein the beverage temperature decreases by at least 22° C. in less than 5 minutes.

29. The cooling device of claim 25, wherein the beverage temperature decreases by at least 22° C. in less than 3 minutes.

30. The cooling device of claim 15, wherein the cooling device decreases the temperature of a beverage in a beverage container by at least 22° C. after actuation, the sorbent section occupying less than 5 cubic centimeters per fluid ounce of beverage, the liquid refrigerant reservoir containing less than 1.5 grams of liquid refrigerant per ounce of beverage.

31. The cooling device of claim 30, wherein the liquid refrigerant is water.

32. The cooling device of claim 30, wherein the beverage temperature decreases by at least 22° C. in less than 10 minutes.

33. The cooling device of claim 30, wherein the beverage temperature decreases by at least 22° C. in less than 5 minutes.

34. The cooling device of claim 30, wherein the beverage temperature decreases by at least 22° C. in less than 3 minutes.

35. The cooling device of claim 15, wherein the cooling device occupies less than 0.5 fluid ounces per fluid ounce of a beverage in a beverage container.

36. A cooling device comprising:

a casing surrounding at least one sorbent section containing a sorbent for a liquid refrigerant;

at least one liquid passageway section adjacent the sorbent section, the liquid passageway section defining a liquid passageway through at least a portion of the cooling device to the sorbent section;

at least one wicking material disposed in the liquid passageway section;

at least one thermal spacer in contact with the sorbent section;

a vapor-permeable membrane interposed between the liquid passageway section and the thermal spacer;

a heat-removing material in thermal contact with the sorbent;

at least one liquid barrier interposed between the heat-removing material and the sorbent;

a liquid refrigerant reservoir adjacent the liquid passageway section; and an actuator for controlling liquid communication between the liquid passageway section and the liquid refrigerant reservoir.

37. The cooling device of claim 36, wherein the heat-removing material is a phase-change material.

38. The cooling device of claim 36, wherein the casing is made from a flexible metallicized plastic.

39. The cooling device of claim 36, wherein the cooling device decreases the temperature of a beverage in a beverage container by at least 22° C. after actuation, the sorbent section having a mass of less than 3 grams per fluid ounce of beverage, the liquid refrigerant reservoir containing less than 1.5 grams of liquid refrigerant per fluid ounce of beverage.

40. The cooling device of claim 39, wherein the liquid refrigerant is water.

41. The cooling device of claim 39, wherein the beverage temperature decreases by at least 22° C. in less than 10 minutes.

42. The cooling device of claim 39, wherein the beverage temperature decreases by at least 22° C. in less than 5 minutes.

43. The cooling device of claim 39, wherein the beverage temperature decreases by at least 22° C. in less than 3 minutes.

44. The cooling device of claim 36, wherein the cooling device decreases the temperature of a beverage in a beverage container by at least 22° C. after actuation, the sorbent section occupying less than 5 cubic centimeters per fluid ounce of beverage, the liquid refrigerant reservoir containing less than 1.5 grams of liquid refrigerant per ounce of beverage.

45. The cooling device of claim 44, wherein the liquid refrigerant is water.

46. The cooling device of claim 44, wherein the beverage temperature decreases by at least 22° C. in less than 10 minutes.

47. The cooling device of claim 44, wherein the beverage temperature decreases by at least 22° C. in less than 5 minutes.

48. The cooling device of claim 44, wherein the beverage temperature decreases by at least 22° C. in less than 3 minutes.

49. The cooling device of claim 36, wherein the cooling device occupies less than 0.5 fluid ounces per fluid ounce of a beverage in a beverage container.

50. A cooling device comprising:

a casing surrounding a liquid managing insulation material which has a hydrophilic region on one side and a hydrophobic region on the opposite side;

at least one sorbent section containing a sorbent for a liquid refrigerant each adjacent to the hydrophobic region of the liquid managing insulation material;

a gas permeable liquid barrier formed at the junction of the sorbent and the hydrophobic region, whereby only the vapor from the liquid refrigerant may pass into the sorbent;

at least one liquid passageway section, the liquid passageway section defining a liquid passageway through at least a portion of the cooling device to the hydrophilic side of the liquid managing insulation material a heat-removing material in thermal contact with the sorbent;

at least one liquid barrier interposed between the heat-removing material and the sorbent;

a liquid refrigerant reservoir adjacent the liquid passageway section; and an actuator for controlling liquid communication between the liquid passageway section and the liquid refrigerant reservoir.

51. The cooling device of claim 50, wherein the heat-removing material is a phase-change material.

52. The cooling device of claim 50, wherein the casing is made from a flexible metallicized plastic.

53. The cooling device of claim 50, wherein the cooling device decreases the temperature of a beverage in a beverage container by at least 22° C. after actuation, the sorbent section having a mass of less than 3 grams per fluid ounce of beverage, the liquid refrigerant reservoir containing less than 1.5 grams of liquid refrigerant per fluid ounce of beverage.

54. The cooling device of claim 53, wherein the liquid refrigerant is water.

55. The cooling device of claim 53, wherein the beverage temperature decreases by at least 22° C. in less than 10 minutes.

56. The cooling device of claim 53, wherein the beverage temperature decreases by at least 22° C. in less than 5 minutes.

57. The cooling device of claim 53, wherein the beverage temperature decreases by at least 22° C. in less than 3 minutes.

58. The evacuated sorbent assembly of claim 50, wherein the sorbent section is supported on a flexible monolith.

59. A beverage container with integrated cooling device comprising a flexible, plastic lined, beverage pouch with a cooling device integrated into one or more of the side walls.

60. The beverage container of claim 59 further comprising a weakened region in a portion of the container that does not house the cooling device, whereby a straw may be inserted.

61. The beverage container of claim 59 further comprising a beverage held within the container.

62. A method of manufacturing a self-cooling beverage container comprising the steps of:

integrating a cooling device into side panels of a flexible plastic lined material;

heat sealing the side panel with integrated device to a substantially similar side panel, without a cooling device, along the side and bottom edges, thereby forming an open pouch;

filling the opened pouch with a beverage; and sealing the top edge of the filled opened pouch.

63. The method of claim 62 wherein a weakened region is formed in a portion of the pouch, whereby a sealed and filled pouch may be pierced with a plastic straw.

64. The method of claim 62 wherein a bottom panel constructed of substantially similar material as the side panels also plastic lined as heat sealed at the bottom and in between the side panels thereby forming a base upon which the beverage container can stand.

* * * * *